US012806495B2

(12) United States Patent
Hacking

(10) Patent No.: US 12,806,495 B2
(45) Date of Patent: Nov. 24, 2026

(54) TRAINING AND/OR AMUSEMENT DEVICE

(71) Applicant: Lynxsport GmbH, Rheinau (DE)

(72) Inventor: Andrew Hacking, Rheinau (DE)

(73) Assignee: LYNXSPORT GMBH, Rheinau (DE)

( * ) Notice: Subject to any disclaimer, the term of this patent is extended or adjusted under 35 U.S.C. 154(b) by 166 days.

(21) Appl. No.: 18/899,032

(22) Filed: Sep. 27, 2024

(65) Prior Publication Data

US 2025/0108278 A1 Apr. 3, 2025

(30) Foreign Application Priority Data

Sep. 29, 2023 (EP) ..... 23201092

(51) Int. Cl.
*A63B 63/00* (2006.01)
*A63B 71/06* (2006.01)

(52) U.S. Cl.
CPC ..... *A63B 63/004* (2013.01); *A63B 71/0669* (2013.01); *A63B 2071/0625* (2013.01)

(58) Field of Classification Search
CPC ..... A63B 63/004; A63B 71/0669; A63B 2071/0625
USPC ..... 473/478
See application file for complete search history.

(56) References Cited

U.S. PATENT DOCUMENTS

| | | | | |
|---|---|---|---|---|
| 3,037,776 | A * | 6/1962 | Younce | A63B 63/00 124/53.5 |
| 6,945,881 | B2 * | 9/2005 | Bates | A63B 71/06 473/422 |
| 8,413,990 | B2 | 4/2013 | Allshouse et al. | |
| 8,480,517 | B2 | 7/2013 | Guttler | |
| 9,457,249 | B2 * | 10/2016 | Goldberg | A63B 63/004 |
| 10,130,859 | B1 * | 11/2018 | Riley | A63B 69/0097 |
| 10,864,424 | B2 | 12/2020 | Amsalem et al. | |
| 11,285,373 | B2 | 3/2022 | Peterson et al. | |
| 11,660,514 | B1 | 5/2023 | Black et al. | |
| 2011/0070981 | A1 * | 3/2011 | Allshouse | A63B 63/00 473/476 |
| 2025/0205574 | A1 | 6/2025 | Dolgin-Gardner | |

FOREIGN PATENT DOCUMENTS

| | | | |
|---|---|---|---|
| CA | 3024607 | A1 | 11/2017 |
| CN | 117618861 | A | 3/2024 |
| ES | 2608256 | A1 | 4/2017 |
| WO | 2012141597 | A1 | 10/2012 |

* cited by examiner

*Primary Examiner* — Daniel A Hess

(74) *Attorney, Agent, or Firm* — Tucker Ellis LLP

(57) ABSTRACT

A training and/or amusement device, the device providing a plurality of targets for a projectile propelled by a user. The plurality of targets includes a first opening and a second opening, the second opening being in two-way communication with the first opening via a path through at least a portion of the device such that, in use, a projectile entering the device through the first opening can pass along the path and exit the device through the second opening and vice versa. The device includes at least one indicator operable to direct the user to propel the projectile from outside the device towards one or more of the targets provided by the device. The device also includes at least one sensor operable to sense motion of the projectile along the path.

15 Claims, 2 Drawing Sheets

TRAINING AND/OR AMUSEMENT DEVICE

RELATED APPLICATION DATA

This application claims priority to European Application No. 23201092.6 filed Sep. 29, 2023. The entirety of the aforementioned application is incorporated herein by reference.

TECHNICAL FIELD

This disclosure relates to a training and/or amusement device, for instance, but not exclusively, for improving a user's skills in a sport or game.

BACKGROUND

In order to improve their skills in a sport or game involving a projectile such as a ball or a puck, a user may practise propelling, e.g. throwing or kicking, a projectile towards a target or a selection of targets. Even if such activity is not directed towards training for a specific sport or game, it may still provide the user with some amusement, entertainment and/or physical and/or mental exercise.

Repetition can be important in order to master a particular skill within a sport or game. Repetition in practice and/or training can be made less boring by introducing challenge and/or progression.

WO 2012/141597 discloses a training apparatus for use in training football basic technique comprising one opening on each side of the apparatus being adapted to entrance angles for at least one rail guiding a ball in a loop from one opening to the other, and a wall adjustable in height as well as sideways is fixed between said openings, where both openings for the ball can be used as entrance/exit and vice versa.

SUMMARY

A first aspect provides a training and/or amusement device, the device providing a plurality of targets for a projectile propelled by a user, wherein the plurality of targets includes a first opening and a second opening, the second opening being in two-way communication with the first opening via a path through at least a portion of the device such that, in use, a projectile entering the device through the first opening can pass along the path and exit the device through the second opening and vice versa, wherein the device comprises: at least one indicator operable to direct the user to propel the projectile from outside the device towards one or more of the targets provided by the device, including at least one indicator operable to direct the user to propel the projectile from outside the device towards the first opening and at least one indicator operable to direct the user to propel the projectile from outside the device towards the second opening; at least one sensor operable to sense motion of the projectile along the path; wherein the sensor(s) is/are operably connected to the indicator(s) such that after sensing motion of the projectile along the path one of the indicators is selectively activated to direct the user to propel the projectile towards one of the targets provided by the device.

One or more times, e.g. each time, the projectile exits the device through the first opening or the second opening during a play session an indicator then directs the user to propel the projectile towards one of the targets provided by the device.

One or more of the indicators may be operable to provide a visual signal to the user. One or more of the indicators may be operable to provide an audible signal to the user.

The device may comprise one or more guide members arranged to guide, in use, the projectile along the path or a portion thereof.

In implementations, a guide member may extend along substantially all of a length of the path.

One or more of the guide members may be curved at least in part.

One or more of the guide members may comprise a rail, a wall or a tube or part thereof. One or more of the guide members may be perforated at least in part.

The guide member(s) may define at least partially the path.

The path may be enclosed at least in part.

The path may be curved at least in part.

The path may comprise one or more branches.

The device may comprise a controller operably connected to the sensor(s) and/or the indicator(s). For example, the controller may comprise a processor.

The controller or the processor may be arranged to receive signals from the sensor(s) operable to sense motion of the projectile along the path and, following receipt of a given signal, selectively activate one of the indicators subsequently to direct the user to propel the projectile towards one of the targets provided by the device.

The first opening may comprise an arch.

The second opening may comprise an arch.

In an implementation, the first opening and the second opening may be connected by a panel. The first opening and/or the second opening may be formed in the panel. The panel may have any shape and dimensions. The panel may be flat and/or curved at least in part.

The first opening and the second opening may be disposed at any angle relative to each other. In an implementation, the first opening and the second opening may lie in a common plane.

The targets provided by the device may comprise one or more further openings. One or more of the further openings, e.g. each one of the further openings, may be in two-way communication with another one of the openings via a path through at least a portion of the device such that, in use, a projectile entering the device through a first one of the openings can pass along the path and exit the device through another one of the openings and vice versa.

The device may comprise a display, e.g. an electronic display, configured to provide information to the user. Information provided to the user via the display may include timing data or scoring data.

The or a controller may comprise a memory.

The device may comprise a counter. The counter may be operably connected to the or a controller.

The device may comprise a timer.

One or more of the sensors operable to sense motion of the projectile along the path may be configured to sense motion of the projectile as, shortly before or shortly after the projectile exits the device via an opening.

In an implementation, the device may comprise a first sensor operable to sense motion of the projectile as, shortly before or shortly after the projectile exits the device via the first opening and a second sensor operable to sense motion of the projectile as, shortly before or shortly after the projectile exits the device via the second opening.

One or more of the sensors operable to sense motion of the projectile along the path may be configured to sense motion of the projectile as, shortly before or shortly after the projectile enters the device via an opening.

In an implementation, the device may comprise a first indicator operable to direct the user to propel the projectile from outside the device towards the first opening and a second indicator operable to direct the user to propel the projectile from outside the device towards the second opening.

The plurality of targets may include one or more rebounders. One or more of the rebounders may comprise a resiliently mounted plate.

The device may comprise one or more sensors operable to detect an impact of the projectile on the rebounder(s).

One or more of the indicators may have an activated state and a deactivated state.

In an implementation, the device may comprise an indicator operable to direct the user to propel the projectile from outside the device towards the rebounder.

A given play session may be open-ended or may have a duration determined by the or a controller and/or programmed by the user. The duration of the play session determined by the or a controller and/or programmed by the user may be random or may be a predetermined length of time. The duration of the play session may be at least 10 seconds, up to or at least 1 minute, up to or at least 5 minutes, up to or at least 10 10 minutes or up to or at least 30 minutes.

The projectile may be a ball or a puck. In implementations, the projectile may be adapted for use in a particular sport or activity. For example, the projectile may be a football. The football may be any size, e.g. a mini football, size 2 football, size 3 football, size 4 football or size 5 football.

In implementations, the projectile may be a hockey ball, a basketball, a volleyball, a golf ball, a marble, a table tennis ball, a tennis ball or a squash ball.

A second aspect provides a use of a training and/or amusement device according to the present disclosure, e.g. a training and/or amusement device according to the first aspect, to practise a user's skills in an activity such as a sport or a game.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

BRIEF DESCRIPTION OF THE DRAWINGS

Examples will now be described with reference to the following drawings, in which.

DETAILED DESCRIPTION

Figure 1:
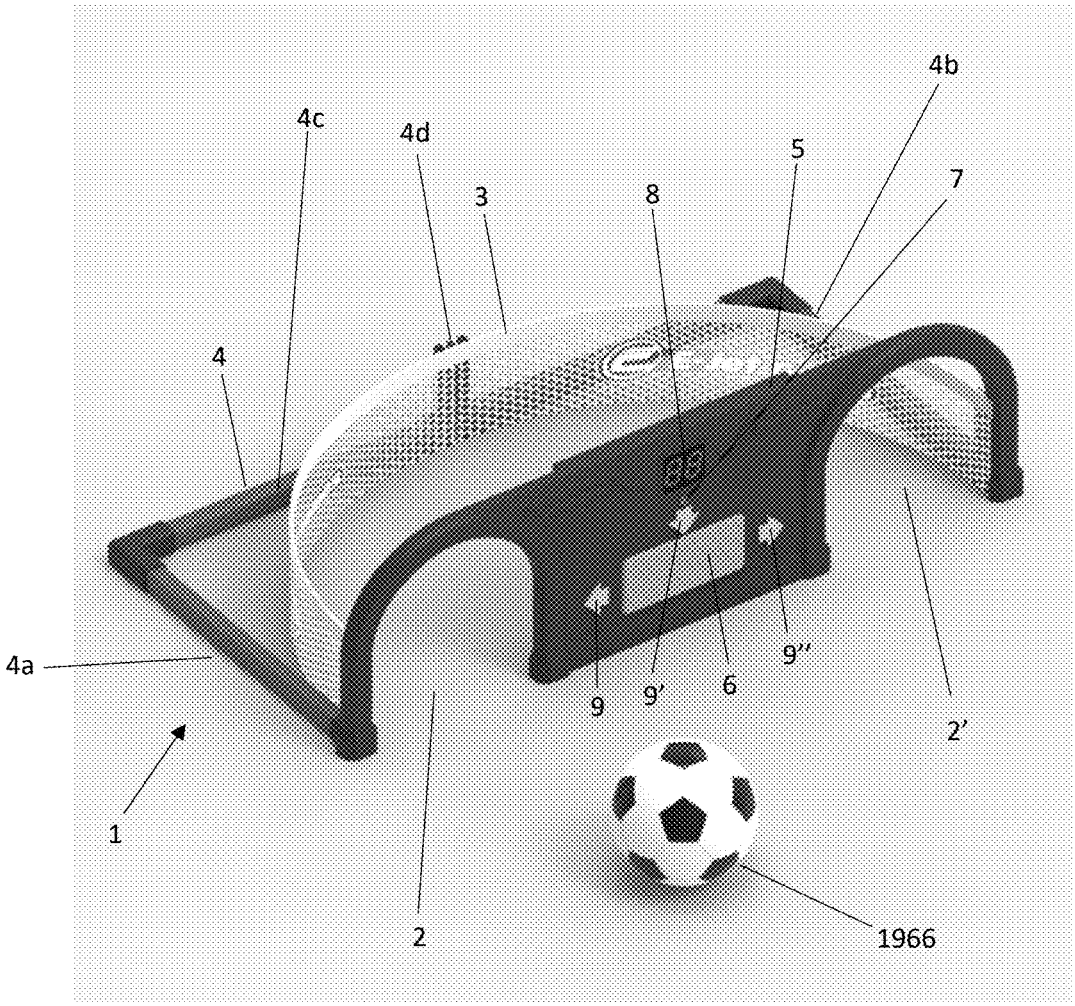
FIG. 1 shows an example of a football training device.

A football training device 1 is shown in FIG. 1.

The football training device 1 comprises a panel 5 attached to a supporting frame 4 which extends behind the panel 5. Disposed within the supporting frame 4 is a guide member 3 which is attached both to the supporting frame 4 and the panel 5 such that it forms a curve.

The panel 5 comprises a first opening 2 and a second opening 2' situated at opposite ends of the panel 5 and having a distance between them. Both the first opening 2 and the second opening 2' comprise an arch. As will be described in more detail below, the guide member 3 is arranged to direct a ball 1966 that enters the football training device 1 through the first opening 2 towards the second opening 2' such that the ball 1966 exits the football training device 1 through the second opening 2' and vice versa.

The supporting frame 4 comprises a first ground-contacting member 4*a*, a second ground-contacting member 4*b*, a ground-contacting cross member 4*c* and a support member 4*d*.

A first end of the first ground-contacting member 4*a* is connected to a rear surface of the panel 5 at a location outboard of the first opening 2. A first end of the second ground-contacting member 4*b* is connected to the rear surface of the panel 5 at a location outboard of the second opening 2'. The ground-contacting cross member 4*c* connected a second end of the first ground-contacting member 4*a* to a second end of the second ground-contacting member 4*b*. The ground-contacting cross member 4*c* is parallel to the panel 5 and both the first and second ground contacting members 4*a*, 4*b* are perpendicular to the both the panel 5 and the ground-contacting cross member 4*c*.

The support member 4*d* extends upwards from the ground-contacting cross member 4*c*. The support member 4*d* is located half-way along the ground-contacting cross member 4*c*.

A first end of the guide member 3 is attached to the panel 5 adjacent an outboard edge of the first opening 2. A second end of the guide member 3 is attached to the panel 5 adjacent an outboard edge of the second opening 2'. At an intermediate point the guide member 3 is attached to the support member 4*d*. The guide member 3 forms a curved, generally semicircular wall. The guide member 3 is perforated with a plurality of holes.

A rebounder 6 is disposed in a front surface of the panel 5 centrally between the first and second openings 2, 2'. Also disposed in the front surface of the panel 5 are a first indicator 9, a second indicator 9', a third indicator 9", a button 7 and an electronic display 8. The first indicator 9 comprises an arrow pointing towards the first opening 2. The second indicator 9' comprises an arrow pointing towards the rebounder 6. The third indicator 9" comprises an arrow pointing towards the second opening 2'.

The first indicator 9, the second indicator 9' and the third indictor 9" each have an deactivated state and an activated state. In the deactivated state, the arrow is not illuminated. In the activated state, the arrow is illuminated, in order to direct a user to aim the football towards the first opening 2, the rebounder 6 or the second opening 2' for the first indicator 9, the second indicator 9' or the third indicator 9" respectively.

The rebounder 6 comprises a plate resiliently mounted within the panel 5.

The button 7 is disposed above the second indicator 9'. The electronic display 8 is disposed above the button 7.

The football training device 1 comprises a first motion sensor (not shown), a second motion sensor (not shown), an impact sensor (not shown) and a processor (not shown). The processor is operably connected to the first and second motion sensors and to the impact sensor. The processor is also operably connected to the button 7 and to the electronic display 8.

The first motion sensor is configured to send a signal to the processor when it detects the football 1966 passing through the first opening 2 in a direction that is away from the supporting frame 4 (i.e. when the football 1966 is exiting the football training device 1). The second motion sensor is configured to send a signal to the processor when it detects the football 1966 passing through the second opening 2' in a direction that is away from the supporting frame 4 (i.e. when the football 1966 is exiting the football training device 1).

The impact sensor is configured to send a signal to the processor when it detects the football 1966 hitting the rebounder 6.

The processor is configured to communicate with a memory. The memory may be used to store data, including, for example a predetermined time period, a score and/or a predetermined indicator sequence.

The football training device 1 may be connectable to any suitable source of electrical energy, e.g. one or more batteries and/or a mains electricity supply.

In use, the button 7 may be used to switch the football training device 1 on and to control how it functions as described below.

In an exemplary mode of operation, the use of the football training device 1 may be as follows. When the football training device 1 is switched on using button 7, the processor begins a countdown. The countdown may be displayed on the electronic display. An exemplary time-period for the countdown may be 60 seconds. The processor also activates one of the first, second or third indicators, 9, 9' or 9". The active indicator may be the first indicator 9. This instructs a user to kick the football 1966 through the first opening 2. If the football 1966 is struck with sufficient force through the first opening 2, the football 1966 is guided by the guide member 3 such that the football 1966 passes through the second opening 2' in a direction towards the user. As the football 1966 passes through the second opening 2', the second motion sensor detects the motion of the football 1966 and sends a signal to the processor. The processor interprets this signal as a successful pass and may increases a count of successful passes stored in a memory. The count of successful passes may be displayed on the electronic display 8.

The processor then deactivates the previously active first indicator 9 and chooses, either randomly or in accordance with a predetermined sequence, to activate the first indicator 9 again, the second indicator 9' or the third indicator 9". For example, the processor may act to activate the second indicator 9'. The user, having now received or retrieved the football 1966, is instructed by the active second indicator 9' to kick the football 1966 at the rebounder 6. If the football 1966 strikes the rebounder with sufficient force to trigger the impact sensor, the impact sensor sends a signal to the processor, the processor interprets this signal as a successful pass and increases the count of successful passes. The count of successful passes may be displayed briefly on the electronic display 8.

The processor then deactivates the previously active second indicator 9' and chooses, either randomly or in accordance with a predetermined sequence, to activate the first indicator 9, the second indicator 9' again or the third indicator 9". For example, the processor may act to activate the third indicator 9". The user, having now received or retrieved the football 1966, is instructed by the active third indicator 9" to kick the football 1966 through the second opening 9". If the football 1966 is struck with sufficient force through the second opening 2', the football 1966 is guided by the guide member 3 such that the football 1966 passes through the first opening 2 in a direction towards the user. As the football 1966 passes through the first opening 2, the first motion sensor detects the motion of the football 1966 and sends a signal to the processor. The processor interprets this signal as a successful pass and may increases a count of successful passes stored in a memory. The count of successful passes may be displayed on the electronic display 8.

This cycle continues until the processor determines that the countdown has been completed i.e., that the pre-chosen time-period has elapsed. The processor may do this by means of a decreasing counter and an instruction it receives once the counter reaches zero. Upon completion of the time-period, the processor may display the count of successful passes on the electronic display. The button 7 may be used to switch off the football training device 1 after use.

The processor may determine any order for the first, second and third indicators, 9, 9' and 9", to be switched on. The order may be preconfigured, for example a loop of the first indicator 9, the second indicator 9' then the third indicator 9", repeating. The order may be random or pseudo-random.

Figure 2:
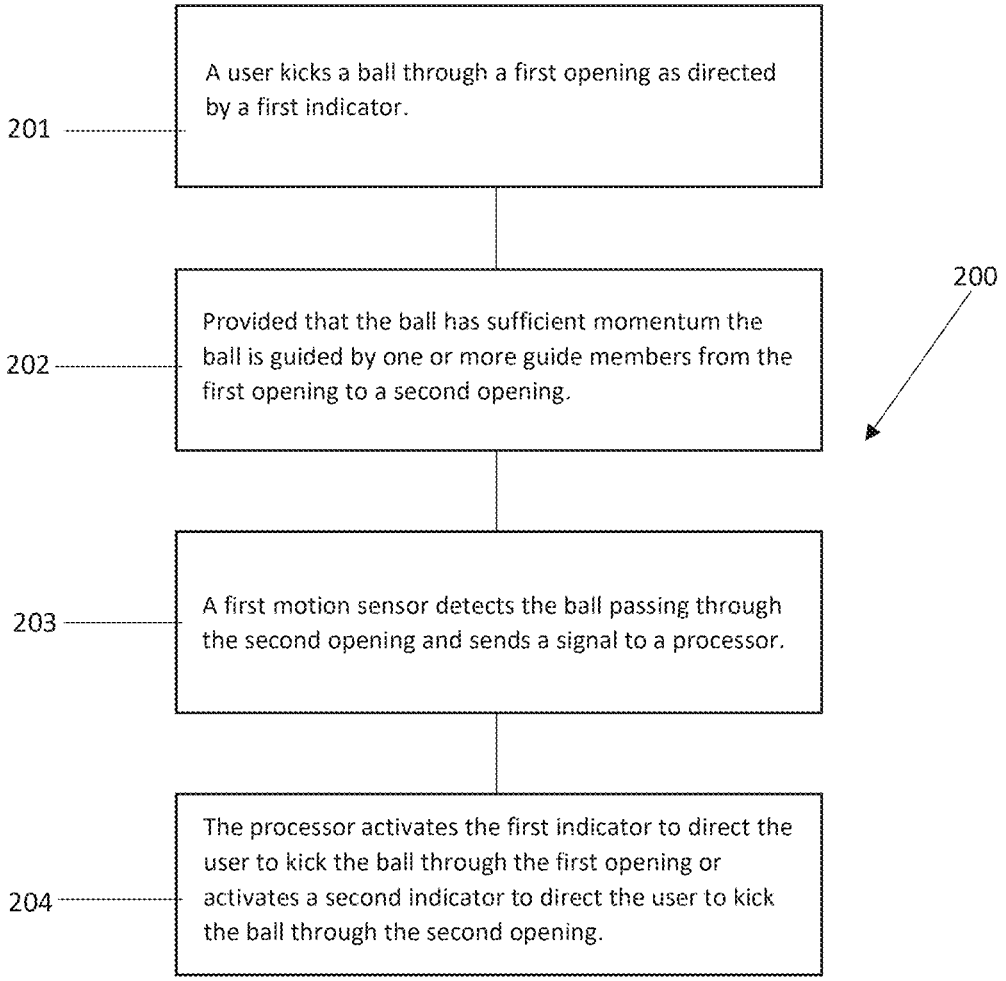
FIG. 2 is a flowchart illustrating an example use of a training device.

FIG. 2 is a flowchart illustrating an example method 200 of using a training and/or amusement device according to the present disclosure, e.g. the football training device 1.

In a first step 201, a user kicks a ball through a first opening as directed by a first indicator.

In a second step 202, provided that the ball has sufficient momentum the ball is guided by one or more guide members from the first opening to a second opening.

In a third step 203, a first motion sensor detects the ball passing through the second opening and sends a signal to a processor.

In a fourth step 204, the processor activates the first indicator to direct the user to kick the ball through the first opening or activates a second indicator to direct the user to kick the ball through the second opening.

In a session of use of the device, one or more of the steps in the method may be repeated. A session of use of the device may be a training session. A session of use of the device may be a game.

In response to the signal from the first or second motion sensors, the processor may increment a counter by one unit to keep track of the number of successful passes made by the user.

The processor may also control a countdown over a fixed time-period which may be used to indicate to the user the start and/or end of the session of use of the device.

Accurate passing is an essential skill in the sport of football. The teaching of the present disclosure may provide a training and/or amusement device that is capable of providing stimulating solo or small group training of this key skill.

While we have described this invention in the context of use as a football training device, it may be used for a variety of sports or games, in particular ball sports or ball games, including, for example, cricket, hockey, snooker, pool, golf, bowls and handball. It may also be used in connection with sports or games that are played with a puck or similar, e.g. ice hockey or air hockey.

A training and/or amusement device according to the present disclosure may be a variety of sizes. For example, the training and/or amusement device may be configured to be a toy or it may be configured for use in a more formal sports- and/or game-training environment.

It will be understood that the invention is not limited to the embodiments described above. Various modifications and improvements can be made without departing from the concepts disclosed herein. Except where mutually exclusive, any of the features may be employed separately or in combination with any other features and the disclosure extends to all combinations and sub-combinations of one or more features disclosed herein.

The invention claimed is:

1. A training and amusement device, the device providing a plurality of targets for a projectile propelled by a user, wherein the plurality of targets includes a first opening and a second opening, the second opening being in two-way communication with the first opening via a path through at least a portion of the device such that, in use, a projectile entering the device through the first opening can pass along the path and exit the device through the second opening and vice versa, wherein the device comprises: at least one indicator operable to direct the user to propel the projectile from outside the device towards one or more of the targets provided by the device, including at least one indicator operable to direct the user to propel the projectile from outside the device towards the first opening and at least one indicator operable to direct the user to propel the projectile from outside the device towards the second opening; at least one sensor operable to sense motion of the projectile along the path; wherein the sensor(s) is/are operably connected to the indicator(s) such that after sensing motion of the projectile along the path one of the indicators is selectively activated to direct the user to propel the projectile towards one of the targets provided by the device.

2. The device of claim 1, wherein one or more of the indicators is/are operable to provide a visual signal to the user or one or more of the indicators is/are operable to provide an audible signal to the user.

3. The device of claim 1, comprising one or more guide members arranged to guide, in use, the projectile along the path or a portion thereof.

4. The device of claim 1, wherein the path is curved or enclosed at least in part.

5. The device of claim 1, comprising a controller operably connected to the sensor(s) or the indicator(s).

6. The device of claim 5, wherein the controller is arranged to receive signals from the sensor(s) operable to sense motion of the projectile along the path and, following receipt of a given signal, selectively activate one of the indicators subsequently to direct the user to propel the projectile towards one of the targets provided by the device.

7. The device of claim 1, wherein the first opening comprises an arch and the second opening comprises an arch.

8. The device of claim 1, wherein the first opening and the second opening are connected by a panel.

9. The device of claim 1, wherein the targets provided by the device comprise one or more further openings.

10. The device of claim 9, wherein one or more of the further openings is/are in two-way communication with another one of the openings via a path through at least a portion of the device such that, in use, a projectile entering the device through a first one of the openings can pass along the path and exit the device through another one of the openings and vice versa.

11. The device of claim 1, wherein: the device comprises a display; the device comprises a memory; the device comprises a timer; and/or the device comprises a counter.

12. The device of claim 1, wherein one or more of the sensors operable to sense motion of the projectile along the path may be configured to sense motion of the projectile as, shortly before or shortly after the projectile exits the device via an opening.

13. The device of claim 12 comprising a first sensor operable to sense motion of the projectile as, shortly before or shortly after the projectile exits the device via the first opening and a second sensor operable to sense motion of the projectile as, shortly before or shortly after the projectile exits the device via the second opening.

14. The device of claim 1, comprising a first indicator operable to direct the user to propel the projectile from outside the device towards the first opening and a second indicator operable to direct the user to propel the projectile from outside the device towards the second opening.

15. The device of claim 1, wherein the plurality of targets includes one or more rebounders.

* * * * *